United States Patent [19]

Turner, Jr. et al.

[11] Patent Number: 4,682,710

[45] Date of Patent: Jul. 28, 1987

[54] MULTI-STATION VISCOUS LIQUID DISTRIBUTION SYSTEM

[75] Inventors: Herman E. Turner, Jr.; Robert D. Glowacki, both of Elyria, Ohio

[73] Assignee: Nordson Corporation, Amherst, Ohio

[21] Appl. No.: 852,368

[22] Filed: Apr. 15, 1986

[51] Int. Cl.[4] ..... B67D 5/08

[52] U.S. Cl. ..... 222/63; 222/71; 222/74; 222/146.2; 222/255; 222/263; 222/333; 222/380; 222/383; 417/45; 118/683; 239/76

[58] Field of Search ..... 222/52, 63, 71, 73, 222/74, 75, 146.2, 252, 255, 263, 265, 333, 372, 380, 383, 405; 417/45, 426; 239/76; 118/683; 318/305, 306, 308, 309, 310, 268

[56] References Cited

U.S. PATENT DOCUMENTS

| | | | |
|---|---|---|---|
| 1,618,006 | 2/1927 | Hawxhurst . | |
| 3,000,053 | 9/1961 | Hart . | |
| 3,051,417 | 8/1962 | Frost et al. . | |
| 3,052,378 | 9/1962 | Wright et al. . | |
| 3,496,261 | 2/1970 | Parr . | |
| 3,692,214 | 9/1972 | Liedberg et al. | 222/334 |
| 3,720,373 | 3/1973 | Levey | 239/127 |
| 3,885,739 | 5/1975 | Tuttle | 222/75 X |
| 3,977,603 | 8/1976 | Magee, Jr. | 239/76 |
| 3,997,080 | 12/1976 | Langstroth | 222/61 |
| 4,009,825 | 3/1977 | Coon | 318/305 X |
| 4,009,974 | 3/1977 | Scholl | 418/181 |
| 4,165,818 | 8/1979 | Bernard | 222/53 |
| 4,227,069 | 10/1980 | Gardner et al. | 222/146.5 X |
| 4,245,759 | 1/1981 | Baker et al. | 222/146.5 |
| 4,279,360 | 7/1981 | Hauser | 222/1 |
| 4,389,001 | 6/1983 | Franklin | 222/63 |

*Primary Examiner*—Joseph J. Rolla
*Assistant Examiner*—David H. Bollinger
*Attorney, Agent, or Firm*—Wood, Herron & Evans

[57] ABSTRACT

A system for dispensing multiple discrete streams of a high viscosity liquid material, and particularly, systems such as those for applying sealants to the seams of an automobile body on a production line. The system is provided with a multi-speed pump for supplying the viscous liquid from a reservoir at high pressure to a distribution manifold from which it is distributed at regulated rates to a plurality of extrusion guns through drop lines from the manifold. A motor speed control which is settable to a number of predetermined motor operating speeds which selects the speed of the multi-speed pump in response to the combination of guns which is activated, so that the dispensing rate can remain the same regardless of which other guns are activated. Regulators which include volumetric metering pumps are included in the drop lines at each of the guns, with controls coordinated with the motor speed control.

20 Claims, 2 Drawing Figures

MULTI-STATION VISCOUS LIQUID DISTRIBUTION SYSTEM

This invention relates to the dispensing of viscous liquids and more particularly, to a system for dispensing multiple discrete streams of viscous liquids from a common liquid source.

At the present time, a number of highly viscous liquids, many of which are solid at room temperature, are applied to products on production lines. These include caulks, adhesives, sealants and the like. Many processes call for the dispensing of these materials onto workpieces in precisely placed and uniform streams.

In an automobile production line, for example, some form of seam sealer is used to cover and protect very nearly every seam or joint of the automobile bodies. This seam sealer is applied for purposes of excluding water or air, preventing leaking, and combatting corrosion. Presently, most commercial sealers comprise a vinyl plastisol or eposy that is pumped to one or more manually or robotically operated extrusion guns. While the sealant material can be supplied from a five-gallon container operable to supply only a single extrusion gun when only a small volume of given liquid is required, the sealant is often required in larger quantities and supplied from a 55 gallon drum operable to feed a manifold system to which multiple guns are attached. The present invention relates to such larger volume systems, and more generally, to systems employing multiple guns to dispense the viscous material in multiple discrete streams from a single source.

Prior art commercial systems have generally been unsatisfactory because of large variations in the rate at which viscous material is deposited. Engineers have attempted to solve the problem by inserting fluid pressure regulators into the extrusion gun supply system immediately upstream of each of the extrusion guns. Those pressure regulators, though, did not solve this problem, primarily because the viscosity of the material was too great for regulators to operate effectively. Pressure changes effected by reciprocation of the piston of a piston pump, for example, were reduced by the pressure regulator but were still transmitted through the distribution manifold to the gun. Those pressure changes resulted in varying flows of material from the gun.

Additionally, in systems in which a plurality of guns were operated from a common distribution manifold, whenever one gun was opened or closed to initiate or terminate dispensing of material from that gun, pressure changes occurred which resulted in varying flow rates at the other guns. This is the problem to which the present invention is primarily directed.

The problem of applying sealant to a seam of an automobile so as to effectively cover that seam without the use of excessive sealant material, for example, has been partially solved by providing a volumetric metering gear pump in the sealant supply system in the drop lines to each of the extrusion guns of an automboile welded seam sealant applicator system to meter and control the volumetric deposition of sealant material from the gun. The metering gear pump is provided downstream from a pressure regulator in the supply to each of the extrusion guns to reduce pressure surges and uneven flow variations in the bead of material applied by the extrusion guns so that only so much sealant is applied to a welded seam as is required to adequately cover that seam without the application of excess material.

With the higher degrees of automation involving robotics to apply these sealants, adhesives or such other highly viscous liquids, reliance upon manual compensation of variations in application rate is not possible. For that reason and to utilize a greater precision which is available in the operation of robots, higher uniformity in the fluid flow rate is desirable. In systems in which many guns are supplied from the same source of high viscosity liquid, improvement over the prior art techniques is desirable to reduce or eliminate a degree of flow and pressure change otherwise observable at each of the guns as other guns in the system are activated and eactivated. This result occurs because the pressure drops through various system components are highly dependent on flow volume for liquids of such high viscosity. The variations range from totally unacceptable on the one hand to where improvement is nonetheless desirable on the other. In situations where robotically controlled guns are used especially, a superior degree of uniformity in material application and precision in control of the flow rate are important and become limiting factors in the performance of the automated system.

To achieve improvement in the performance of these systems, it has been proposed that source pump pressure be varied so as to control the total flow in direct response and in proportion to the number of guns which are activated. It has been found, however, that flow rates and pressure drops to different guns will differ and that changes in pressure and flow rate are not simply additive and that each combination of guns activated may require different control responses to eliminate the effects of one gun upon another.

It has been a principle objective of the present invention to provide a very accurate apparatus for uniformly dispensing high viscosity liquid in systems which multiple extrusion guns supplied from a single pressurized source are simultaneously but independently operated to deposit viscous materials in multiple discrete streams on workpieces. It has been a more particular objective of the present invention to provide such an apparatus for applying sealant to seal seams in an automobile assembly process.

It has been a further objective of the present invention to provide a system for depositing multiple streams of highly viscous liquid in an assembly process in which a plurality of extrusion guns are supplied with the viscous liquid from a single pressurized source so that the extrusion of liquid from each gun may be kept to a uniform flow notwithstanding that the operation of each gun or each different combination of guns may alter to a different degree the pressure drops or flows in the components of the system.

In one preferred embodiment of the present invention, the system for applying the sealant to the seams of an automobile comprises a large reservoir, such as a 55 gallon drum, from which sealant material is pumped by a multi-speed primary pump. The pump speeds are determined by a control which provides a plurality of separately adjustable speed settings, each of which determines a pump speed at which the pump will operate in response to each different combination of guns that are activated. This pump supplies the liquid material to an overhead manifold line from which there extends a plurality of drop lines. Each drop line terminates in a manually or a robotically operated extrusion gun.

In the application in which the illustrated embodiment of the invention is described, further advantages are provided, and the performance of the system is enhanced by the combination of multi-speed primary pump and volumetric metering pumps at each of the guns, particularly with their controls interrelated. In such a combination an electric motor driven metering gear pump is connected to each of the drop lines downstream from a pressure regulator so that liquid is supplied to each of the extrusion guns through a metering pump at a fixed and constant flow and pressure. An electric or pneumatic control circuit links each of the guns with both the multi-speed pump and the respective metering pump for the gun, and supplies the logic to activate the pumps and select the appropriate primary pump speed. Thereby, an even and precise amount of liquid is extruded from each gun at an even more uniform and predetermined rate. Accordingly, the effect of the operation of one gun upon that of another is reduced to a minimum or eliminated altogether.

These and other objects and advantages of this invention will be more readily apparent from the following description of the drawings in which.

Figure 1:
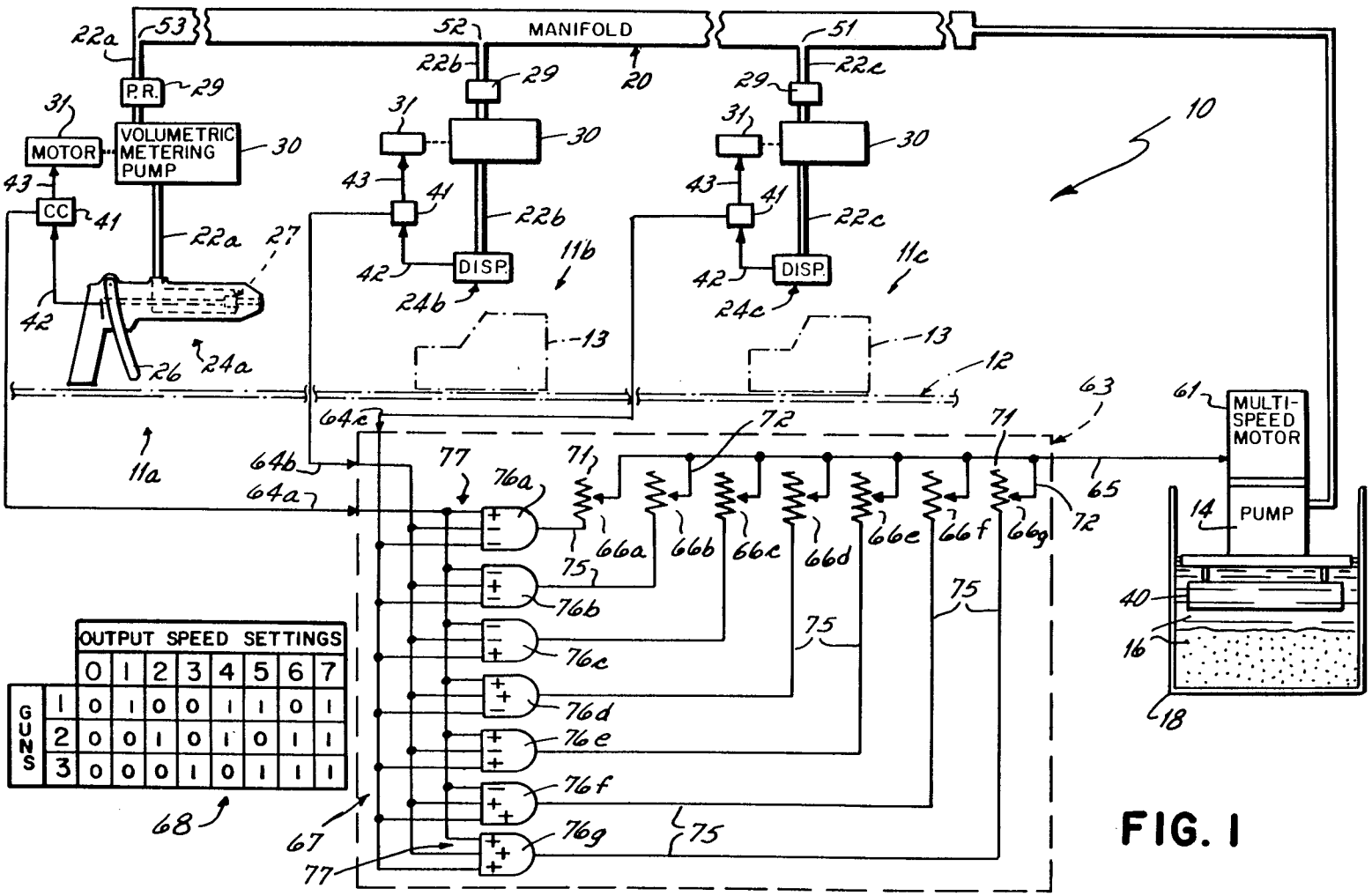
FIG. 1 is a partially diagrammatic illustration of a viscous liquid distribution system incorporating principles of the present invention.

With reference first to FIG. 1, there is diagrammatically illustrated a system 10 for distributing a highly viscous liquid to multiple distribution stations 11 along a processing line 12. At each of the distribution stations 11, illustrated as 11*a*, 11*b*, and 11*c*, the system 10 operates to dispense a discrete stream of the liquid on one or more workpieces 13.

In an automobile assembly line, for example, the welded seams of an automobile are covered with a sealant material to exclude water or air and to combat corrosion. This sealant is highly viscous, and often is heated or melted in order to flow in the system at all. The sealant is either applied before or after the welding of the seams and either before or after any primer paint or any preparatory coating treatment of the body. It is most often desirable that the sealant be applied simultaneously, either on the same or on different workpieces, at multiple points along the assembly line from different dispensing devices often supplied from the same source. The illustrated embodiment is described in the context of such an application.

The system 10 comprises a primary pump 14 for pumping sealant material 16 from a drum or container 18 to a distribution manifold 20. Because of the high viscosity of the sealant material, the pump 14 commonly supplies the material to the distribution manifold at a pressure on the order of 1,000 to 5,000 p.s.i.g. This manifold generally extends parallel to a processing line 12 and is operative to supply pressurized sealant or other highly viscous liquid from the primarly pump 14 to a plurality of drop lines 22 through which the sealant is distributed to multiple dispensing devices 24. These devices are illustrated as extrusion guns 24*a*, 24*b*, and 24*c* located along a production line 12. The guns 24 are symbolically illustrated herein for simplicity as being of the manual type. Referring to gun 24*a*, which is shown in more detail, the gun is controlled from a manually operated trigger 26. One such gun is disclosed in U.S. Pat. No. 4,245,759. The trigger 26 controls the dispensing of the sealant or other such viscous liquid by opening and closing a valve 27 contained internally of the gun 24, The guns 24 could as well be, though and with this invention will more probably be, automatically operable guns controlled and moved relative to the body by robots.

There is associated with each drop line 22 a pressure regulator 29 and a volumetric metering pump 30. Each pump 30 comprises a two-speed gear pump driven by a DC motor 31. Since the gear pumps 30, and the motors 31 for driving the gear pumps 30, as well as the pressure regulators 29, are conventional, commercially available items, they have not been illustrated or disclosed in detail herein.

The primary pump 14 is a conventional electrical or pneumatic motor driven pump, preferably a gear pump, but particularly, it is a pump which is capable of operation at multiple speeds or power levels so as to be able to selectively produce different pressures or fluid flow rates at its output to the manifold 20. If the liquid material 16 is a hot melt material which is virtually solid at room temperature, then a heated platen 40 will be suspended beneath the primary pump 14 to heat and melt the hot melt material from its solid state at room temperature. One appropriate heated platen is disclosed in U.S. Pat. No. 4,227,069. Alternatively, if the liquid is a cold sealant, i.e., liquid at room temperature, then the heated platen will be omitted and the primary pump 14 inlet simply inserted into the cold sealant 16 contained in the drum.

As mentioned hereinabove, the pressure regulators 29 are commercially available items which, because of their commercial availability, have not been illustrated or described herein. The pressure regulators are located upstream of the metering pumps 30, but downstream from the manifold 20. In general, the primary pump 14 will develop very high pressures, often on the order of 1,000 to 5,000 p.s.i.g. Pressure regulators 29 reduce this pressure to the desired operating pressure of the gun and as explained more fully hereinafter with respect to the embodiment illustrated in FIG. 2, may be used to reduce this pressure to zero.

The metering pumps 30 are conventional motor driven gear pumps, such as the gear pump disclosed in U.S. Pat. No. 4,009,974. In some embodiments, this pump is motor driven by a two-speed DC electric motor and may be air clutch activated. The use of a two-speed or multi-speed motor is desirable if that motor is controlled from the trigger 26 of a manually or robotically operated gun 24 because it enables the operator or programmer of the gun to increase or decrease the rate at which material is dispensed from the gun in accordance with the needs of the application. Robotically controlled guns particularly may vary the rate of discharge of viscous liquid, but will do so in accordance with the robot's control program. It has been found that when applying sealant with a manual gun to a straight seam, for example, high speed application may be employed, but when applying the sealant to a rounded corner, a slower speed is employed in order to effect complete coverage of the seam without application of excessive sealant material. When a robot controlled gun is used, a large number of motor speeds or a variable speed motor may be used to drive the metering pump 30 in accordance with the speed of the robot relative to the target substrate.

The metering pumps 30 are activated by control circuits 41 each having an input line 42 connected to the respective gune 24 to receive input signals in response to the activation of the trigger 26 of the gun 24, to develop an output at its output terminal 43 which is connected to the motor 31. The control circuit 41 causes the pumps 30 to operate in response to the activation of the respective one of the guns 24.

In operation, significant pressure drops are found to occur along each of the various liquid flow paths in the distribution system. The pressure drops are experienced between the pump 14 and the connection point 51 of the manifold 20 to the first drop line 22*c* for the gun 24*c*, between the point 51 and the next connection point 52 of the manifold 20 to the next drop line 22*b* to gun 24*b*, and between the point 52 and the connection point 53 of the manifold 20 to the third drop line 22*a* to the gun 24*a*. Similarly, pressure drops occur in each of the components between the connection points 51, 52 and 53 and each of the guns 24. Most of these pressure drops will change significantly depending on which of the guns 24 is activated and, if more than one is activated, on the combination which is activated. Accordingly, the speed of the primary pump 14 necessary to provide output of optimum consistency at the guns 24 depends on the combination of guns which is activated.

To provide the correct speed of the pump 14, the pump 14 is a variable speed pump, preferably a gear pump similar to the pumps 30. The pump 14 is driven by a multi-speed motor 61. The motor 61 is operable at a number of discrete speeds, each of which is capable of being adjusted, calibrated and selected by a motor speed control 63, which may be of any one of a number of known control techniques, such as electric or pneumatic.

The motor speed control 63 is symbolically illustrated in the diagram with a plurality of input 64, shown as 64*a*, 64*b*, and 64*c*, each connected to the metering pump control circuits 41 to develop input signals in response to the activation status of the respective guns 24*a*, 24*b* and 24*c*. The motor speed control 63 has an output 65 connected to the multi-speed motor 61 to transmit a control signal to the motor 61 to determine the operating speed of the pump 14.

The speed control 63 includes a plurality of variable speed setting devices 66, each connected to the output 65 and each capable of being calibrated to a discrete motor speed. The control 63 also includes a logic circuit 67 connected between inputs 64 and variable speed setting devices 66. The logic circuit 67 is operable to select a different one of the speed setting devices 66 in response to each unique combination of conditions of operation of the guns 24. As such, each of the speed setting devices 66 is operable to set the speed of the motor 61 to drive the pump 14 to provide the precise rate of supply of the viscous liquid 16 which is demanded by each unique combination of guns 24 which is activated. For a system 10 having three guns, this is illustrated by seven distinct speed setting devices 66*a–g* in the control 63. A truth table 68 illustrates the relationship between the various combinations of conditions of the guns 24*a* through 24*c* (a "0" representing the deactivated condition of the respective gun and a "1" representing the activated condition of the respective gun) and each of the speed setting devices 66*a–g*.

Where the pumps 30 are themselves multi-speed pumps, each speed setting is a different condition which multiplies the number of combinations to be dealt with by the truth table 68 and the control device 63, and will increase the number of motor speed settings 66 to be provided for.

The motor speed control 63 is shown by reference to its logic diagram shown in the figure in the context of an electrical control circuit. In this circuit, the speed setting devices 66*a–g* are variable resistors 71, each having the variable output terminal 72 connected to the output 65 of the control 63. Each of the resistances 71 has a fixed terminal, each connected to a different one of the outputs 75 of AND-gates 76. Each of the AND gates 76 has a plurality of positive or negative inputs 77, each connected to a different one of the inuts 64 of the control 63. Each of the gates 76 has its inputs 77 connected to the inputs 64 in a unique combination of positives and negatives representing respectively the on and off activation states of the guns, and corresponding to the logic of the truth table 68.

Given the logic diagram shown, one skilled in the art of controls will be able to readily provide a specific control 63 suitable for the application and compatible with the other components of the system. For example, an electromechanical control using multiple contact relays or solid state switching devices might be selected for an electric multi-speed motor 61. A penumatic control might use spool valves activated by the inputs 64 if the input lines are otherwise pneumatic and with such a design, the speed setting devices 66 may be pressure regulator valves. Where robotics are employed, the control program of the robots may dictate or might itself replace the entire control 63. Those skilled in this art will appreciate the options available.

Where the liquid is to be dispensed from a conventional robotically controlled automatic gun, the control circuit 41 may also be part of a control program for the guns 24, for both the robots and the motors 31 which drive the metering pumps 30. The motors 31 may be controlled through the activation of a clutch, such as an air clutch, between the motor 31 and the metering pump 30 operable to selectively engage the motor 31 with the metering pump 30. Similarly, the motor speed control may be of any one of a number of conventional control devices available to one skilled in the art and might also operate to control the motor 61 through selective activation of an air clutch. All controls may be either special purpose control devices or part of a programmable module or otherwise incorporated into a robot control program device.

Preliminary to operation, the motor speed setting 66 must be predetermined and adjusted. When first used, or if the configuratin or parameters of the system have been changed since last used, then each of the settings 66*a–g* are set to calculated or estimated values. Then the system is brought up to operating steady state condition. As the pump 14 is activated, the viscous liquid 16 is supplied at a very high pressure, generally on the other of from 1,000 to 5,000 p.s.i.g. from drum 18 to the distribution manifold 20. As each of the guns 24 is activated, this viscous liquid material is supplied from the distribution manifold 20 through the pressure regulators 29 and the metering pumps 30 to the extrusion guns 24. When the trigger 26 of a gun 24 is activated, the valve 27 contained internally of the gun 24 is opened. In response thereto, the motor 31 for driving the metering gear pump 30 is activated and the viscous liquid material is dispensed from the gun at a controlled volumetric rate determined by the control circuit 41. This continues as long as the trigger remains open.

Figure 2:
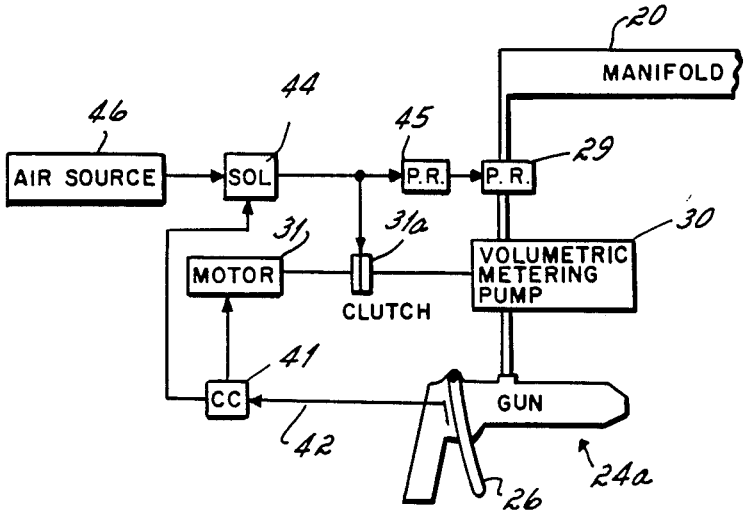
FIG. 2 is a partially diagrammatic illustration of a modified portion of the system of FIG. 1. The illustrated embodiment of the invention as described below is a viscous liquid distribution system for applying a highly viscous sealing or caulking material as will be found in systems such as those for applying sealant to seams of an automobile during assembly.

With reference to FIG. 2, there is illustrated a modified portion of the system of FIG. 1, which modified portion is operative to enable the pressure regulator 29 to function as both a pressure regulator and an on/off valve. By so using the pressure regulator 29, leakage through the regulator to the gun or dispenser 24 may be eliminated when the valve of the gun or dispenser 24 is closed.

With reference to FIG. 2, it will be seen that only the connection of one gun or dispenser 24*a* to the manifold 20 is illustrated. It should be appreciated, though, that in accordance with this second modification, each gun 24*a*, 24*b* and 24*c* will be connected to the manifold 20 by the same hydraulic pneumatic control circuit as is illustrated in FIG. 2.

With reference to FIG. 2, it will be seen that a pneumatic actuated clutch 31a interconnects the motor 31 with the metering pump 30. It will also be seen that the pressure regulator 29 of this embodiment is a pilot operated hydraulic pressure regulator, the pilot of which is activated by air pressure from an air pressure source 46 supplied to the regulator 29 through a solenoid valve 44 and an air pressure regulator 45. The pilot operated pressure regulator is conventional in the art and per se forms no part of the invention of this application. One such suitable pilot operated pressure regulator is manufactured by Rexson Pumps Ltd. of Rugby, England and is identified as a Rexson Model #631150 Pressure Regulator.

In the operation of the system, illustrated in FIG. 2, actuation of the trigger 26 of gun 24*a* results in a signal being sent to the control circuit 41, which signal simultaneously causes the motor 31 to be energized and the solenoid valve 44 to be opened. This valve 44 connects air from the air pressure source 46 to the pneumatically operated clutch 31*a* and to the pilot operated pressure regulator 29. The air pressure supplied to the clutch 31*a* causes that clutch to engage and interconnect the motor 31 to the metering pump 30. Air pressure supplied to the pilot section of the pressure regulator 29 causes that pressure regulator to open,thereby connecting the manifold 20 to the metering pump 30. When the trigger of the gun 24*a* is subsequently released or opened, the signal from that trigger on line 42 to the control circuit 41 is operative to inactivate the motor 31 and close the solenoid valve 44, thereby disconnecting the pneumatic clutch 31*a* and the pilot of pressure regulator 29 from the source of air pressure 46. The metering pump 30 is therefore stopped and the pressure regulator 29 closed. Closing of the pressure regulator 29 has the beneficial effect of preventing leakage of pressure through the pressure regulator and through the metering pump 30 the gun. It has been found that in the absence of a pilot operated pressure regulator, there is a tendence to liquid pressure to leak from the manifold through the pressure regulator 29 and the pump 30 to the gun 24 when the gun valve is closed. If this occurs, that leakage of pressure results in excessive flow from the gun when the gun valve is subsequently opened. The pilot operated valve 29 with it control circuit prevents such excessive flow caused by pressure leakage through the pressure regulator when the gun valve is closed. The control circuit associated with the pressure regulator, and particularly the use of the solenoid valve 44 with that regulator, prevents the regulator 29 from sticking in one position.

In adjusting the settings 66 to predetermine the speeds of the pump 14, each of the guns 24*a* through 24*c* will be activated one at a time while the appropriate speed for the pump 14 is set by adjustment of the settings 66*a* through 66*c*, respectively. Thereafter, the guns are activated in pairs 24*a* and *b*, 24*a* and *c*, and 24*b* and *c*, and the settings 66*d* through f, respectively, are adjusted to set the speed for the pump 14 to provide the same discharge characteristics at the guns 24*a* through *c* as existed when the guns were operated separately. Then all three of the guns 24*a* through *c* are activated and the setting 66*g* is adjusted so that the discharge characteristics are similarly matched.

Then, after the settings 66 have been properly adjusted, the operation of the system 10 proceeds, for example, as follows:

If gun 24*a* is alone activated, a signal is generated along input line 64*a* to the inputs 77 of the gates 76 in the control 63. Input signals at inputs 64*b* and *c* are absent. Accordingly, as illustrated on the truth table 68, the condition for selecting only output speed 1 is satisfied. The selection is accomplished by the passage of a signal through gate 76*a* only and through only speed settings 66*a* which has been calibrated to predetermine the speed of pump 14 when, and only when, gun 24*a* alone is operating.

Then, for example, if gun 24*b* is then actuated, either by a human operator or under the control of a programmed robot, a signal also appears at input 64*b* of the control 63. This disables gate 76*a* and simultaneously enables gate 76*d*, to switch the speed of pump 14 from that determined by setting 66*a* to that determined by setting 66*d*, which the truth table 68 shows is the output speed setting 4. Depending on the time responses of the system components, additional control means may be provided by one skilled in the art to make the speed transition smooth and uninterrupted. The speed setting 66*d* controls the speed of pump 14 so that the discharge conditions at gun 24*a* are unaffected by the activation of gun 24*b*. Similarly, if gun 24*a* is then deactivated, the input signal at input 64*a* goes to zero, disabling gate 76*d* and simultaneously enabling gate 76*b*, supplying a control signal at the output 65 to the pump 14 which is determined by the setting 66*b*, corresponding to speed 2 in the truth table 68. As this occurs, the gun 24*a* is deactivated while the discharge characteristics of gun 24*b* remain unchanged and unaffected by the operation of gun 24. This is because the speed settings 66 are set so as to cause the pump 14, by changing its speed, to compensate for the diverse pressure drops in the system components as the guns 24 are switched on and off and operated in different combinations. The operation follows the same pattern for all combinations of operation of the guns 24. Accordingly, the objectives of the invention are achieved in a system of multiple distribution stations.

While only two embodiments of the invention have been described, persons skilled in the art to which the invention pertains will appreciate numerous different applications, modifications and changes which can be made with the viscous liquid distribution system described without departing from the spirit of the invention.

What is claimed is:

1. A system for dispensing multiple discrete streams of high viscosity liquids from a common liquid source comprising:

a distribution manifold, a plurality of extrusion guns, each of said guns being independently operable to dispense said liquid in a stream onto a workpiece when activated, and each having an activator for activating said gun, a plurality of connector lines, each of said connector lines having an input end connected to said distribution manifold and a discharge end connected to a different one of said guns, a multi-speed primary pump connected between said source and said distribution manifold for supplying said liquid to said distribution manifold at high pressure, a plurality of regulators, each of said regulators being connected in a different one of said connector lines for regulating the rate of flow of said liquid from said distribution manifold to said guns, and a motor and a motor speed control for controlling the speed of said multi-speed primary pump, said control including a plurality of adjustable motor speed setting devices, each of said devices being operable when selected to supply a motor speed control signal to said motor, and a logic circuit with an input for receiving input signals responsive to the activitation of each of said guns, said logic circuit being operative to select a different one of said setting devices in response to each combination of input signals at said input.

2. The system of claim 1 wherein each of said regulators includes a volumetric metering pump connected in said connector line, and a pressure regulator located in said connector line between said distribution manifold and said volumetric metering pump.

3. The system of claim 2 wherein each of said volumetric metering pumps is driven by a motor, said motor being a variable speed motor so as to enable the flow of liquid from said guns to be varied.

4. The system of claim 2 wherein each of said pressure regulators comprises a pilot operated pressure regulator.

5. The system of claim 4 wherein each of said pilot operated pressure regulators is connected to a control circuit operative to open and close said regulator in response to activation of said guns.

6. The system of claim 1 wherein said motor speed control includes a plurality of control circuits each connected between said logic circuit input and a different one of said regulators for controlling said regulator in response to the activation of the gun connected to the respective connector line.

7. The system of claim 1 further comprising a control circuit responsive to the activation of said guns to control said regulators.

8. The system of claim 1 for dispensing a high viscosity sealant material onto a seam of an automobile during production, wherein:

said distribution manifold extends generally along an automobile production line, and said extrusion guns are each positioned along said production line, and each of said guns is operable to dispense sealant onto an automobile on said line.

9. The system of claim 8 wherein each of said regulators includes a volumetric metering pump connected in said connector line, and a pressure regulator located in said connector line between said distribution manifold and said volumetric metering pump.

10. The system of claim 9 wherein said motor speed control includes a plurality of control circuits each connected between said logic circuit input and a different one of said regulators for controlling said regulator in response to the activation of the gun connected to the respective connector line.

11. A system for dispensing multiple discrete streams of high viscosity liquids from a common liquid source comprising:

a distribution manifold, a plurality of extrusion guns, each of said guns being independently operable to dispense said liquid in a stream onto a workpiece when activated, a plurality of connector lines, each of said connector lines having an input end connected to said distribution manifold and a discharge end connected to a different one of said guns, a multi-speed primary pump connected between said source and said distribution manifold for supplying said liquid to said distribution manifold at high pressure, a motor and motor speed control means for effecting different discrete speeds of said multi-speed primary pump in response to each different combinations of guns activated at any time so that the dispensing rate of the guns remains substantially the same as different combination of guns are activated.

12. The system of claim 11 wherein said motor speed control means comprises a plurality of adjustable motor speed setting devices, each of said devices being operable when selected to supply a discrete motor speed control signal to said motor.

13. A system for dispensing multiple discrete streams of high viscosity liquids from a common liquid source comprising a distribution manifold, a plurality of extrusion guns, each of said guns being independently operable to dispense said liquid in a stream onto a workpiece when activated, a plurality of connected lines, each of said connector lines having an input end connected to said distribution manifold and a discharge end connected to a different one of said guns, a multi-speed primary pump connected between said source and said distribution manifold for supplying said liquid to said distribution manifold at high pressure, a motor and motor speed control means for controlling the speed of said multi-speed primary pump in response to the combination of guns activated at any time so that the dispensing rate of the guns remains substantially the same as different combination of guns are activated, said motor speed control means comprising a plurality of adjustable motor speed setting devices each of said devices being operable when selected to supply a discrete motor speed control signal to said motor, and a logic circuit with an input for receiving input signals responsive to the activation of each of said guns, said logic circuit being operative to select a different one of said setting devices in response to each combination of input signals at said input.

14. The system of claim 13 which further comprises a plurality of metering pumps, each of said metering pumps being connected in a different one of said connector lines for regulating the rate of flow of said liquid from said distribution manifold to one of said guns.

15. The system of claim 14 wherein each of said metering pumps is a volumetric metering pump connected in one of said connector lines, and a pressure regulator located in each of said connector lines between said distribution manifold and said volumetric metering pump.

16. The system of claim 15 wherein said motor speed control means includes a plurality of control circuits each connected between said logic circuit input and a different one of said metering pumps for controlling said metering pumps in response to the activation of the guns.

17. The system of claim 14 further comprising a control circuit responsive to the activation of said guns to control said metering pumps, 18. The system of claim 15 wherein each of said pressure regulators comprises a pilot operated pressure regulator.

19. The system of claim 18 wherein each of said pilot operated pressure regulators is connected to a control circuit operative to open and close said regulators in response to activation of said guns.

20. A system for dispensing multiple discrete streams of high viscosity liquids from a common liquid source comprising:

a distribution manifold, a plurality of extrusion guns, each of said guns being independently operable to dispense said liquid in a stream onto a workpiece when activated, a plurality of connector lines, each of said connector lines having an input end connected to said distribution manifold and a discharge end connected to a different one of said guns, a multi-speed primary pump connected between said source and said distribution manifold for supplying said liquid to said distribution manifold at high pressure, a motor and motor speed control means for effecting different discrete speeds of said multi-speed primary pump in response to each different combination of guns activated at any time so that the dispensing rate of the guns remains substantially the same as different combinations of guns are activated, said motor speed control means comprising a plurality of adjustable motor speed setting devices, each of said devices being operable when selected to supply a discrete motor speed control signal to said motor, and a logic circuit with an input for receiving input signals responsive to the activation of each of said guns, said logic circuit being operative to select a different one of said setting devices in response to each combination of input signals at said input.

* * * * *

UNITED STATES PATENT AND TRADEMARK OFFICE

CERTIFICATE OF CORRECTION

PATENT NO. : 4,682,710

DATED : July 28, 1987

INVENTOR(S) : Herman E. Turner, Jr., et al.

It is certified that error appears in the above-identified patent and that said Letters Patent is hereby corrected as shown below:

Column 1, line 59, change "automboile" to --automobile--.

Column 2, line 13, change "eactivated" to --deactivated--.

Column 5, line 3, change "gune" to --gun--.

Column 6, line 13, change "inuts" to --inputs--.

Column 6, line 25, change "penumatic" to --pneumatic--.

Column 6, line 57, change "other" to --order--.

Column 7, line 53, before "the gun" insert --to--.

Column 7, line 54, change "tendence to" to --tendency for--.

Column 7, line 60, change "it" to --its--.

Column 10, lines 21-22, change "combinations" to --combination--.

Column 10, line 24, change "combination" to --combinations--.

UNITED STATES PATENT AND TRADEMARK OFFICE

CERTIFICATE OF CORRECTION

PATENT NO. : 4,682,710

DATED : July 28, 1987

INVENTOR(S) : Herman E. Turner, Jr., et al.

It is certified that error appears in the above-identified patent and that said Letters Patent is hereby corrected as shown below:

Column 10, line 39, change "connected" to --connector--.

Column 10, lines 51-52, change "combination" to --combinations--.

Signed and Sealed this

Twenty-ninth Day of November, 1988

*Attest:*

DONALD J. QUIGG

*Attesting Officer*

*Commissioner of Patents and Trademarks*